United States Patent [19]

Guenther

[11] 4,007,938

[45] Feb. 15, 1977

[54] PUTTING DEVICE

[76] Inventor: Arthur William Edward Guenther, 2400 St. Frances Drive, Burlington, Ontario, Canada

[22] Filed: Nov. 7, 1975

[21] Appl. No.: 629,807

[52] U.S. Cl. ..... 273/177 R; 273/184 A

[51] Int. Cl.[2] ..... A63B 69/36

[58] Field of Search ..... 273/177, 194 A, 184 A, 273/185 R, 178, 179, 180

[56] References Cited

UNITED STATES PATENTS

| | | | |
|---|---|---|---|
| 1,136,708 | 4/1915 | Osborn | 273/177 A |
| 2,503,506 | 4/1950 | Miller | 273/194 A X |

*Primary Examiner*—George J. Marlo

[57] ABSTRACT

A device for use in practice putting, in which a barrel slides in a vertically adjustable cylinder with an inverted cup carried by the lower end of the barrel. A horizontal disc beneath the cup carries a vertical rod movable axially in the barrel with a first ball element at its upper end. A second ball element rests in an aperture of the barrel and engages a groove in the cylinder when urged into the groove by the first ball element. Upward movement of the disc moves the first ball element and causes the barrel and the cup to drop.

7 Claims, 3 Drawing Figures

PUTTING DEVICE

This invention relates to a device for use by golfers to practise putting.

Various devices have been developed for golfers enabling them to practise putting in places other than the golf course, such as in the home. In these devices a golf ball rolling into a defined area is trapped in that area by a mechanism. The trapping mechanisms of these prior devices suffer from deficiencies in structure or operation.

It is an object of the present invention to provide an improved putting device of simple construction and operation.

In its broadest aspect the invention consists of a putting device comprising a vertically oriented cylinder; means to mount the cylinder a predetermined distance above the horizontal surface; a barrel slidable vertically in the cylinder and projecting at each end from the cylinder; an inverted cup fixed on the projecting bottom end portion of the barrel; a rod located axially in the barrel and projecting from the bottom end of the barrel; disc means fixed on the lower end of the rod; and means to releasably detain the barrel in a raised position with the cup above the disc means and to release the barrel and drop the cup on upward movement of the disc.

An example embodiment of the invention is shown in the accompanying drawings in which.

Figure 1:
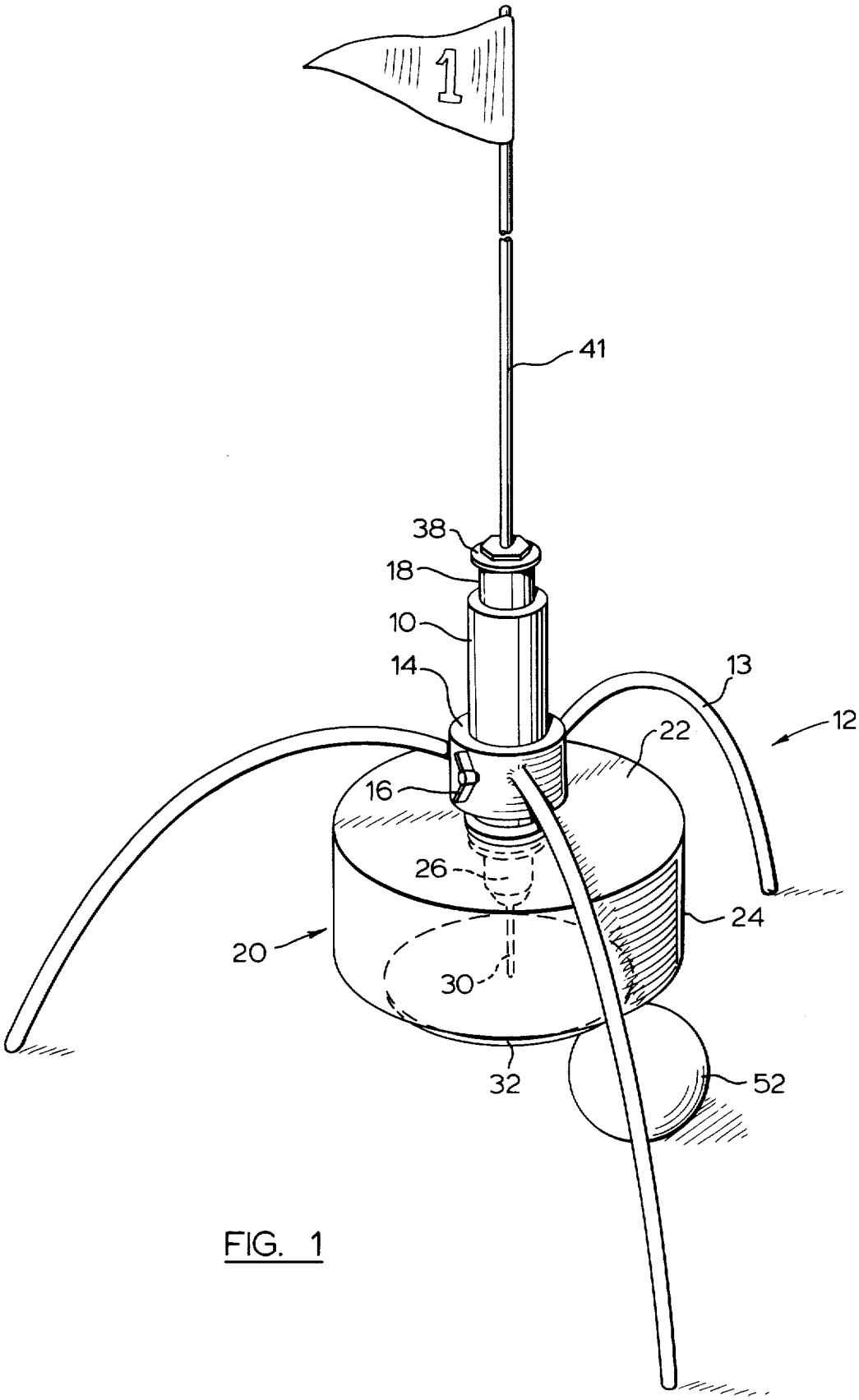
FIG. 1 is a perspective view of the putting device.

The example embodiment shown in the drawings consists of a cylinder 10 which is mounted vertically on a tripod 12 having legs 13 and a collar 14. A wing nut 16 on collar 14 releasably secures cylinder 10 in the collar. A horizontal annular chamfered groove 17 circumscribes the inner wall of cylinder 10.

A barrel 18, having a bore 19, is located coaxially within cylinder 10 and is slidable vertically in the bore. The lower end portion of barrel 18 projects from cylinder 10 and carries an inverted cup 20 having a circular horizontal base 22 and a peripheral depending side wall 24. The diameter of cup 20 is substantially equal to that of a hole in a golfing green. Barrel 18 terminates at its lower end in an inwardly tapered tip portion 26 which is conical at its lower end and truncated to provide a restricted circular opening 28.

A vertical rod 30 is located in bore 19 of barrel 18 and projects downwardly through opening 28 into cup 20, terminating in a horizontal disc 32 having a diameter less than that of cup 20. Rod 30 is centred in opening 28 by an inverted cone element 34 which is fixed coaxially on the rod and is seated in the opening. The upper end of rod 30 freely supports a first ball element 36 which has a diameter slightly less than the diameter of bore 19 to allow the ball element to move freely along the bore. The upper end of barrel 18 projects from cylinder 10 and carries a cap 38 to retain ball element 36 within bore 19. Rim 39 of cap 38 overhangs the barrel. Cap 38 may be hollow to receive a pole 41 press-fitted into a recess (not shown) in the cap.

Barrel 18 has an aperture 40 opening laterally from bore 19. Aperture 40 holds a second ball element 42 which has a diameter slightly larger than the thickness of the wall of barrel 18. An annular plug 44 is located in bore 19 at the lowest point of aperture 40 and rod 30 slides freely in the plug.

Figure 2:
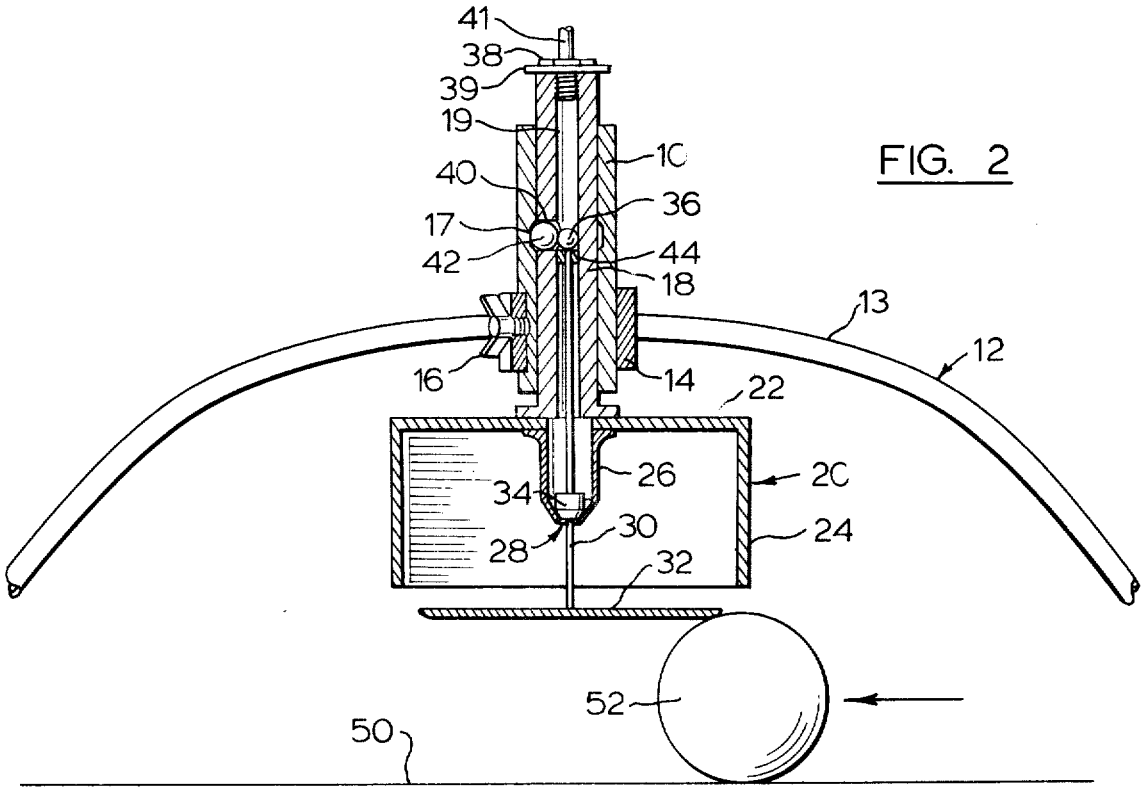
FIG. 2 is a cross-sectional view of the device of FIG. 1 in a position set for actuation.

To operate the described device it is placed on a horizontal surface 50 such as a floor. The device is then set for actuation by raising barrel 18 which can be effected by pushing upwards on cup 20 or by pulling upwards on cap 38 or on pole 41. When barrel 18 is being raised, first ball element 36 bears downwardly against second ball element 42 which projects into bore 19. When second ball element 42 reaches groove 17, the weight of first ball element 36 moves the second ball element into the groove and holds the second ball element in the groove by lying beside the second ball element on plug 44 as seen in FIG. 2 of the drawings. In this position disc 32 is located below cup 20 by the seating of cone element 34 in tip 26 of barrel 18 with the upper end of rod 30 located in plug 44. The distance of disc 32 above surface 50 is then adjusted to be slightly less than the diameter of a golf ball 52. This adjustment is effected by loosening wing nut 16 and sliding cylinder 10 vertically upward or downward, after which the wing nut is tightened.

Figure 3:
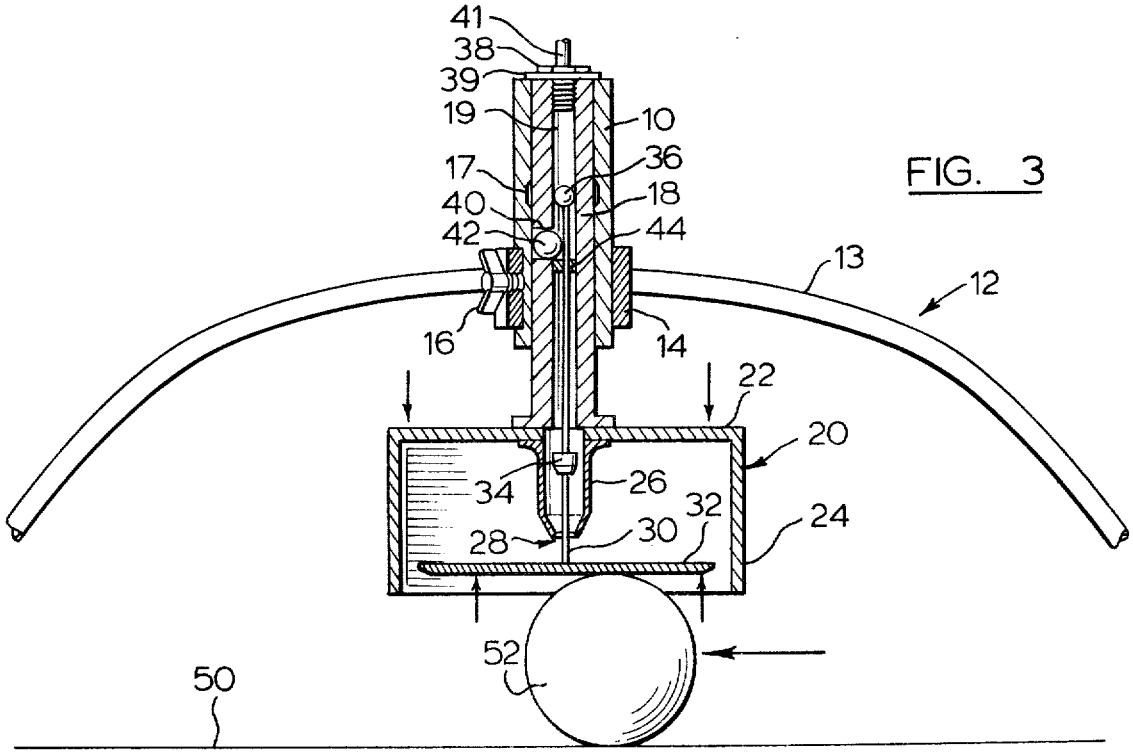
FIG. 3 is a view similar to FIG. 2 showing the device when tripped to trap a golf ball.

When a person putts a golf ball 52 towards cup 20 the ball strikes disc 32 as seen in FIG. 2 and raises the disc by sliding under it as seen in FIG. 3. The arrangement of cone element 34 lying in tip portion 26 allows rod 30 to move laterally in the aperture of the tip portion. This reduces the resistance of rod 30 to vertical movement. As disc 32 is raised, rod 30 and first ball element 36 are also raised, allowing second ball element 42 to move out of groove 29 and into bore 19 of barrel 18, which in turn releases the barrel to drop cup 20 and trap ball element 52 inside the cup. The downward movement of barrel 18 is arrested by rim 39 of cap 38 meeting the upper end of cylinder 10.

It will be noted that there is no obstacle below disc 32. Therefore if ball 52 travels too quickly it will pass beyond cup 20 before the cup can trap the ball, thus simulating the situation where a fast putt on a golfing green causes the ball to overshoot the hole.

Ball 52 is retrieved by raising cup 20 which also resets the device for further use.

It will be appreciated that groove 17 may be located at any point vertically in cylinder 10 and aperture 40 may be located at any point vertically in barrel 18 as long as the relationship between the groove and the aperture allows for the engagement and release of second ball element 42. It will also be appreciated that the term "ball element" is meant to include any convenient shape of elements 36 and 42 which will accomplish the purpose for which they are used. For manufacturing purposes groove 17 may be replaced by a bore of increased diameter extending downwardly from the top of barrel 18. Also, cone 34 may be of any suitable shape, for example spherical, which will enable rod 30 to move laterally within the aperture of tip portion 26 and which will re-seat itself when the device is reset.

I claim:

1. A putting device comprising:

a vertically oriented cylinder;

means to mount the cylinder a predetermined distance above a horizontal surface;

a barrel vertically slidable axially in the cylinder and projecting at least from the lower end of the cylinder;

an inverted cup fixed on the projecting bottom end portion of the barrel;

a rod axially movable vertically in the barrel, the lower end of the rod projecting from the bottom of the barrel;

disc means fixed on the lower end of the rod; and means to releasably detain the barrel in a raised position with the cup above the disc means and to release the barrel and drop the cup on vertical movement of the disc and upward vertical axial movement of the rod.

2. A putting device as claimed in claim 1 in which the means to releasably detain the barrel comprises an annular groove in the cylinder, an aperture in the barrel opening laterally from the bore thereof, means movable in the aperture to engage the groove, and means located in the bore of the barrel to detain the movable means in the groove, said means located in the bore, being movable axially in the barrel to release the means movable in the aperture from the groove.

3. A putting device as claimed in claim 2 in which the movable means comprises a first ball and the means located in the bore comprises a second ball.

4. A putting device as claimed in claim 1 in which the barrel terminates at the lower end thereof in an inverted truncated conical tip defining a restricted aperture, the rod carrying coaxially means seatable in the conical tip.

5. A putting device as claimed in claim 1 in which the means to mount the cylinder comprises a tripod carrying a collar concentric with the cylinder.

6. A putting device as claimed in claim 5 in which a wing nut holds the cylinder releasably in the collar.

7. A putting device as claimed in claim 1 in which the upper end of the barrel projects from the cylinder, and means carried by said upper end constructed and arranged to contact the cylinder on downward movement of the barrel whereby said downward movement is arrested.

* * * * *